US010384100B2

(12) United States Patent
Manou

(10) Patent No.: US 10,384,100 B2
(45) Date of Patent: Aug. 20, 2019

(54) SHOE BASED BOWLING APPARATUS

(71) Applicant: Nicholas Manou, North Myrtle Beach, SC (US)

(72) Inventor: Nicholas Manou, North Myrtle Beach, SC (US)

( * ) Notice: Subject to any disclaimer, the term of this patent is extended or adjusted under 35 U.S.C. 154(b) by 0 days.

(21) Appl. No.: 15/911,848

(22) Filed: Mar. 5, 2018

(65) Prior Publication Data

US 2018/0250558 A1 Sep. 6, 2018

Related U.S. Application Data

(60) Provisional application No. 62/466,773, filed on Mar. 3, 2017.

(51) Int. Cl.

| | |
|---|---|
| ***A43B 3/00*** | (2006.01) |
| ***A43B 5/00*** | (2006.01) |
| ***A43B 5/18*** | (2006.01) |
| ***A43C 19/00*** | (2006.01) |
| ***A63B 47/00*** | (2006.01) |
| ***A63B 69/00*** | (2006.01) |
| ***A63B 71/00*** | (2006.01) |
| *A63B 102/20* | (2015.01) |

(52) U.S. Cl.

CPC ..... *A63B 47/007* (2013.01); *A43B 5/008* (2013.01); *A43B 5/18* (2013.01); *A43C 19/00* (2013.01); *A63B 69/0046* (2013.01); *A63B 71/0009* (2013.01); *A43B 3/0036* (2013.01); *A63B 2102/20* (2015.10); *A63B 2243/0054* (2013.01); *A63B 2243/0062* (2013.01)

(58) Field of Classification Search

CPC ..... B44D 3/12; F16M 13/02; E04H 17/14; A63B 67/06

See application file for complete search history.

(56) References Cited

U.S. PATENT DOCUMENTS

| | | | | |
|---|---|---|---|---|
| 1,296,072 | A * | 3/1919 | Gillespie | H01Q 1/1221 116/173 |
| 3,531,073 | A * | 9/1970 | Cortina | B44D 3/123 248/113 |
| 4,619,545 | A * | 10/1986 | Kuttenbaum | F16B 2/065 403/169 |
| 5,785,447 | A * | 7/1998 | Fonti | E04H 17/1413 403/49 |
| 6,601,813 | B1 * | 8/2003 | Kager | A45D 20/12 248/288.31 |
| 2014/0201976 | A1 * | 7/2014 | Erlenbach | B25H 5/00 29/525.01 |
| 2018/0071603 | A1 * | 3/2018 | Schirmer | A63B 43/00 |

* cited by examiner

*Primary Examiner* — Eugene L Kim
*Assistant Examiner* — Christopher A Glenn
(74) *Attorney, Agent, or Firm* — Stanzione & Associates, PLLC; Patrick Stanzione

(57) ABSTRACT

A shoe based bowling apparatus that includes: a bracket member having a concave shape to receive therein and remain in contact with at least one third of a circumference of a bowling ball; and a tongue member including a first end bent upward at an angle of approximately 90 degrees from a center portion thereof, the first end extending from a center of the bracket member, and a second end bent upward at an angle sufficient to rest along a length of a tongue of a shoe while the first end remains extending away from a surface in which the shoes rests, the second end being connected to a front end of the shoe.

25 Claims, 14 Drawing Sheets

SHOE BASED BOWLING APPARATUS

REFERENCE TO RELATED APPLICATIONS

This application claims one or more inventions which were disclosed in Provisional Application No. 62/466,773 filed Mar. 3, 2017, entitled Shoe Based Bowling Apparatus. The benefit under 35 USC § 119(e) of the United States provisional application is hereby claimed, and the aforementioned application is hereby incorporated herein by reference in its entirety.

BACKGROUND OF THE INVENTION

Traditionally, most sports are based around able-bodied individuals. To play a given sport, a player customarily must have at least one functioning hand and both legs. The sport of bowling is no exception. A customary bowler usually has at least one functioning hand, and two functioning legs, allowing them to pick up a ball and throw the ball down the lane at the arrangement of pins at the far end of the lane.

As a result, prospective bowlers who are not able-bodied are at a distinct disadvantage to more able-bodied bowlers. If the prospective bowler lacks one or both functioning hands, a bowler cannot grasp or throw the ball with their hands. The prospective bowler without hands is left needing to awkwardly kick the ball down the lane. Given that the bowler's foot or shoe is more difficult to manipulate than a hand, a bowler without one or both hands has a difficult time accurately aiming the ball, meaning the handless bowler cannot compete effectively against more able-bodied players.

FIELD OF THE INVENTION

The invention pertains to the field of an apparatus to aid in bowling or playing other ball rolling sports and games. More particularly, the invention pertains to an apparatus connectable to a human foot to aid in the sport of bowling or other ball rolling sports and games.

SUMMARY OF THE INVENTION

The foregoing and/or other features and utilities of the present inventive concept can be achieved by providing a bowling apparatus, including a bracket member having a concave shape to fit a ball of a predetermined size therein; and a tongue member including: a first end bent upward at an angle of approximately 90 degrees from a center portion thereof, the first end being of a length approximately equal to a width of the bracket member and attached along a width of a center of the bracket member; and a second end bent upward at an angle sufficient to rest over a tongue of a shoe while maintaining the first extending away from a surface on which the shoe rests, the second end including lace holes configured to receive shoe laces tied above the tongue of the shoe in which the second end rests.

In an example embodiment, the bracket member and the tongue member can be enclosed in a fabric.

In another example embodiment, the first end of the tongue member and the center of the bracket member can be attached by crews.

In another example embodiment, the first end of the tongue member and the center of the bracket member can be attached by welding.

In still another example embodiment, the first end of the tongue member and the center of the bracket member can be attached by a molding process.

In still another example embodiment, the second end of the tongue member can include four lace holes formed to align with four lace holes of a shoe.

In still another example embodiment, the first end of the tongue member can be approximately 1.5 inches in length, the center of the tongue member can be approximately 3 inches in length, the second end of the tongue member can be approximately one inch in length, and the width of the tongue member can be approximately 5.5 inches in length; and the bracket member can be approximately 9 inches in length and approximately 1.24 inches in width such that the outer ends are approximately 7.25 inches apart.

The foregoing and/or other features and utilities of the present inventive concept can also be achieved by providing a ball rolling apparatus, including: a bracket member having a concave shape to receive therein and remain in contact with at least one third of a circumference of a ball of a predetermined size; and a tongue member including: a first end bent upward at an angle of approximately 90 degrees from a center portion thereof, the first end being of a length approximately equal to a width of the bracket member and attached along a width of a center of the bracket member; and a second end bent upward at an angle sufficient to rest along a length of a tongue of a shoe while maintaining the first end perpendicular to a surface on which the shoe rests, the second end including lace holes configured to receive shoe laces tied above the tongue of the shoe in which the second end rests.

In an example embodiment, the ball can be a bocce ball.

In another example embodiment, the ball can be a croquet ball.

In still another example embodiment, the bracket member and the tongue member can be welded together.

In still another example embodiment, the bracket member and the tongue member can be molded together as a single piece.

In yet another example embodiment, the bracket member and the tongue member can be made from aluminum.

In still another example embodiment, the bracket member and the tongue member can be formed together as a single piece.

In yet another example embodiment, the bracket member and the tongue member can be from of a resin.

The foregoing and/or other features and utilities of the present inventive concept can also be achieved by providing a ball rolling apparatus, comprising: a bracket member having a concave shape to receive therein and remain in contact with at least one third of a circumference of a ball of a predetermined size; and a shoe including a tongue member extending from a front of the shoe, the tongue member including: a first end bent upward at an angle of approximately 90 degrees from a center portion thereof, the first end being of a length approximately equal to a width of the bracket member and attached along a width of a center of the bracket member; and a second end bent slightly upward and extending from the front of the shoe while maintaining the center portion approximately perpendicular to a surface on which the shoe rests.

In an example embodiment, the ball can be a croquet ball.

In another example embodiment, the ball can be a bowling ball.

In another example embodiment, the ball can be a bocce ball.

In still another example embodiment, the bracket member and the tongue member can be enclosed in a fabric.

In still another example embodiment, the first end of the tongue member and the center of the bracket member can be attached by screws.

In yet another example embodiment, the first end of the tongue member and the center of the bracket member can be attached by welding.

In yet another example embodiment, the first end of the tongue member and the center of the bracket member can be attached by a molding process.

In yet another example embodiment, the tongue member and the bracket member can be formed from a single piece of metal.

DETAILED DESCRIPTION OF THE INVENTION

Figure 1A:
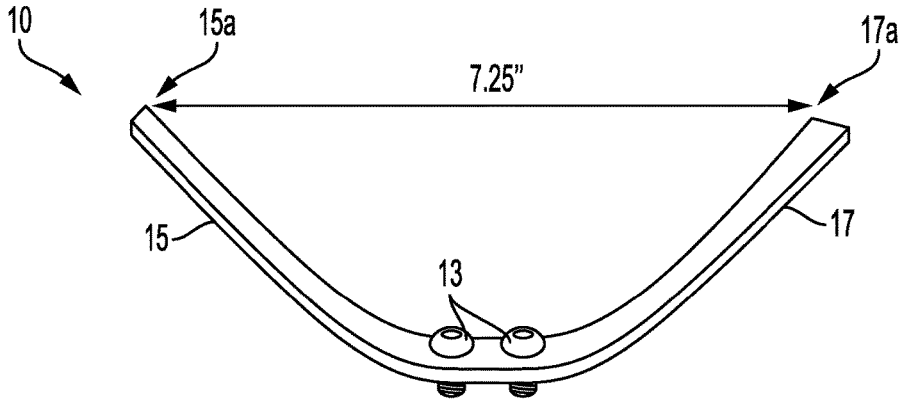
FIG. 1A illustrates an exposed bracket portion of a foot based bowling apparatus in accordance with an example embodiment of the present inventive concept.

In the following description, reference is made to the accompanying drawings that form a part thereof, and in which is shown by way of illustration specific example embodiments in which the present teachings may be practiced. These embodiments are described in sufficient detail to enable those skilled in the art to practice the present teachings and it is to be understood that other embodiments may be utilized and that changes may be made without departing from the scope of the present teachings.

The terminology used herein is for the purpose of describing particular example embodiments only and is not intended to be limiting. As used herein, the singular forms "a", "an", and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly. The term approximately herein refers to being almost, but not completely exact, and within a small variation that will perform the intended purposes as describe herein.

Figure 3A:
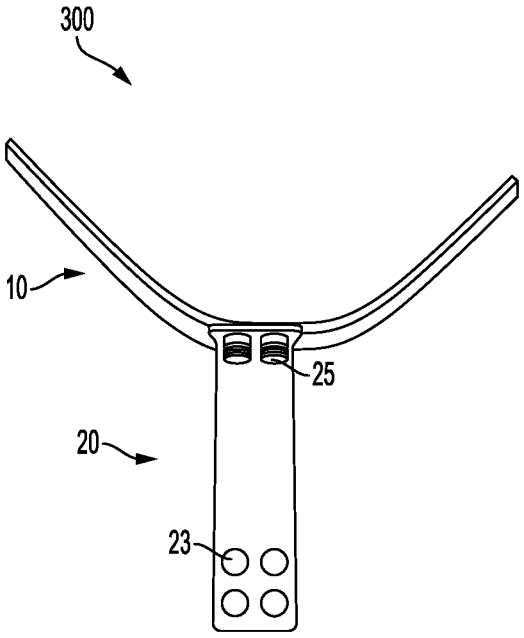
FIG. 3A illustrates a fully assembled exposed foot based bowling apparatus in accordance with an example embodiment of the present inventive concept.

FIG. 3A illustrates a bowling apparatus 300 according to an example embodiment of the present inventive concept. This bowling apparatus 300 can include a bracket member 10 and tongue member 20 combination which may be attached to a shoe. This design, as illustrated in FIG. 3A, aids users with disabilities that prevent them from using their hands while enjoying ball rolling games, such as bowling, which is the conventional way of rolling a bowling ball down a bowling lane to knock down a set of bowling pins. The bowling pins are generally placed at an opposite end of the lane from an end at which the user stands. Other games that entertain the concept of rolling balls include, for example bocce ball and croquet. The bowling apparatus 300 can be applied to these games as well by simply adjusting the size and curvature of the bracket portion 10 to accommodate the differently sized balls.

Figure 4:
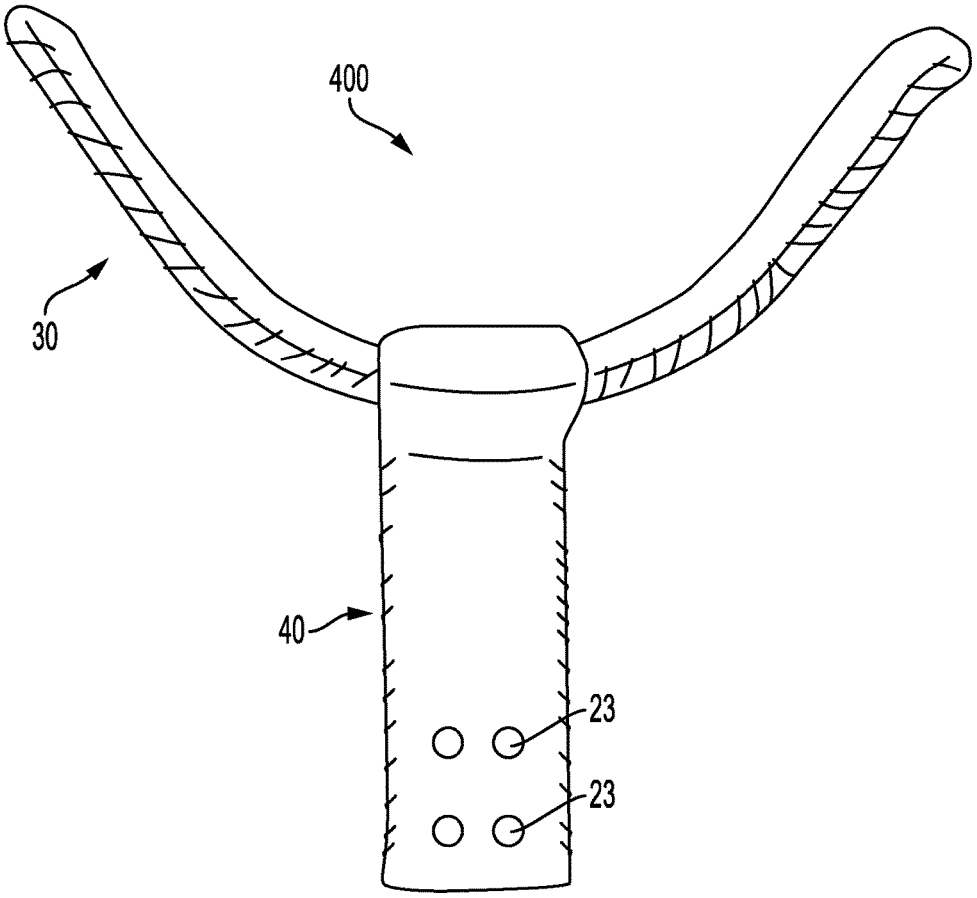
FIG. 4 illustrates the fully assembled foot based bowling apparatus of FIG. 3 in accordance with an example embodiment of the present inventive concept.

Since bowling lanes are officially designed to have dimensions including a length of 60 feet long and a width of 42 inches wide, tossing a bowling ball the length of the bowling lane requires precision. More specifically, in order to keep the ball within the lane's dimensions until the ball reaches a group of pins set up at an opposite end of the bowling lane from an end in which the user stands when rolling the bowling ball down the lane, control and aim of the bowling ball is required prior to releasing the ball. In other words, being able to push and control the trajectory of a bowling ball or other game ball is important, and can be achieved with the apparatus as illustrated in FIG. 4, as is explained in more detail below. Although the following description will refer to using the apparatus of FIG. 4 with a bowling ball, it is to be understood that it can be applied equally to use with other games that entertain rolling a ball while requiring force and control of the trajectory of the ball.

FIG. 1A illustrates a bracket member 10 of the bowling apparatus 300 that is curved to form two arms 15 and 17 that can be customized by bending the two arms 15 and 17 so that a width and curvature of the bracket member 10 can accommodate any size of a user's bowling ball. As illustrated in FIG. 1A, two tongue connection holes 11 can be formed in the bracket 10 in which corresponding screws 13 can be threaded there-through to firmly attach the bracket member 10 to the tongue member 20. After being curved to form the two arms 15 and 17 as described above, the outer ends 15*a* and 17*a* of the arms 15 and 17 may be, for example, approximately 7.25 inches apart from each other when being used for most bowling ball sizes. The distance the arms are apart from each other will be different for differently sized balls used in different games.

Figure 1B:
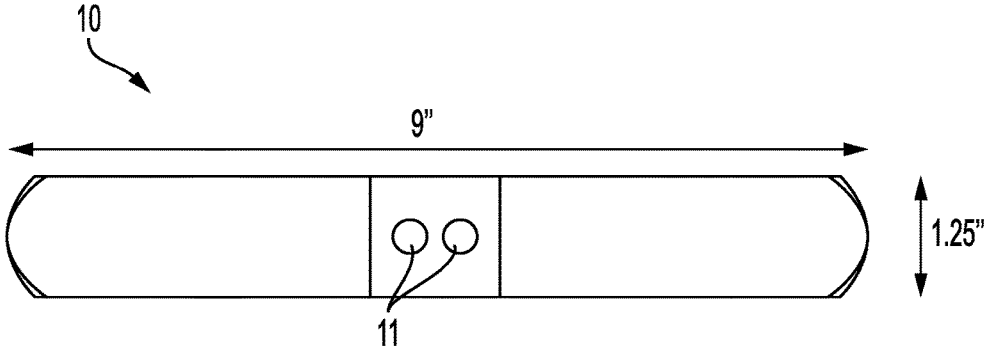
FIG. 1B illustrates the bracket portion of FIG. 1A in a custom shaped form for an individual.

Referring to FIG. 1B, a full width and length view of the bracket member 10 prior to the arms 15 and 17 being customized to accommodate the size of the user's personal bowling ball, and prior to being connected to the tongue member 20. The width of the bracket member 10 can be approximately 1.25 inches wide to maintain sufficient control of a bowling ball, and the length of the bracket member 10 can be approximately 9 inches in length in order to maintain sufficient control of the ball as well as controlling the trajectory in which the ball will be rolled. However, the dimensions of the bracket member 10 can be adjusted to perform the intended purposes of controlling a bowling ball while preparing to roll the ball down a bowling lane at an intended trajectory.

Still referring to FIG. 1B, all four corners of the bracket member 10 can be rounded so that the corners are smooth and do not cause damage or injury when coming into contact with an object or a human. The bracket member 10 can be made from a metal such as aluminum, or a similar type of metal or material that can be shaped by the user after purchase to customize the bowling apparatus 300 to fit the user's bowling ball. However, the material should be strong enough to maintain its shape when the bowling apparatus 300 is in use. The bracket member 10 can alternatively be pre-molded using a plastic material or a synthetic resin, or fiberglass, but is not limited thereto, and can be manufactured with any type material that will provided the intended purposes as described herein.

Figure 2A:
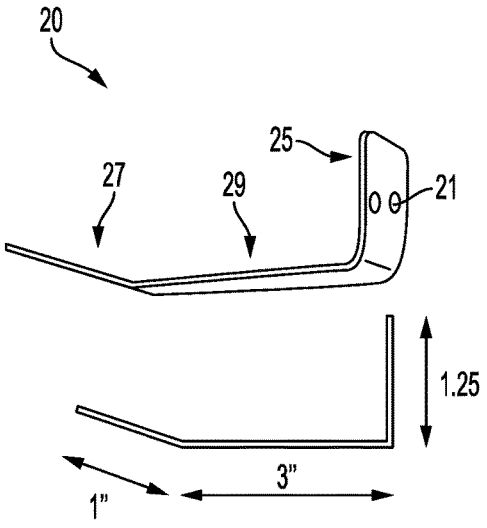
FIG. 2A illustrates an exposed tongue portion of a foot based bowling apparatus in accordance with an example embodiment of the present inventive concept.

FIG. 2A illustrates a side view of the tongue member 20 according to an example embodiment. The tongue member 20 can have a bend at a first end 25 to be properly positioned to be connected to the bracket member 10. Since the width of the bracket member 10 should be approximately perpendicular to the floor of the bowling alley when in use, the first end 25 of the tongue member 20 should bend upward at an angle from a center portion 29 thereof to meet flush with the two bracket portion connection holes 11 of the bracket member 10. Therefore the first end 25 of the tongue member 20 should bend upwards from the center portion 29 at an angle which is also approximately perpendicular to the floor of the bowling alley or other flat surface in which a ball is to be rolled. The first end portion 25 can include two bracket connection holes 21 that align with the two tongue connection holes 11 such that the screws 13 threaded into the two tongue connection holes 11 can also be threaded into the two bracket connection holes 21 to connect the bracket member 10 and the tongue member 20 together, thus forming the body of the bowling apparatus 300.

FIG. 2A also illustrates a second end 27 of the tongue member 20 to be connected with a user's shoe. This second end 27 can be curved upward by a certain degree in the same direction as the first end 25 with respect to the center portion 29 to properly and securely be connected to a user's shoe. As described in more detail below, the second end 27 may have various different forms in order to connect to a shoe in a various number of ways.

Still referring to FIG. 2A, the length of the first end portion 25 can be approximately 1.25 inches in length from the bend between the first end portion 25 and center portion 29, thus being equal to or approximately the same length as the width of the bracket member 10. Therefore when first end portion 25 is connected to the bracket member 10, there is little or no overlap. Further, the length of the second end portion 27 can be approximately one inch in length from the bend between the second end portion 27 and the center portion 29. The center portion 29 can be approximately 3 inches in length.

Figure 2B:
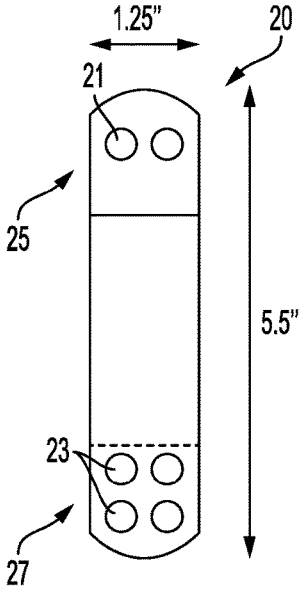
FIG. 2B illustrates the tongue portion of FIG. 2A in a custom shaped form for an individual.

FIG. 2B illustrates a view of the tongue member 20 illustrating the full width and length thereof prior to being connected to the bracket portion 10. The width of the tongue member 20 can be approximately 1.25 inches in width, and the length of the tongue can be approximately 5 inches in length. However, as pointed out above, the dimensions of the different portions of the tongue member 20, as well as the total width and length of the tongue member 20 will be different for bowling balls of different sizes as well as balls being used in different games.

Still referring to FIG. 2B, in an example embodiment, the second end 27 of the tongue member 20 can include four shoe connection holes 23 used to connect the tongue 20 to a shoe or other object to be used for bowling. Four shoe connection holes 23 are illustrated since, from experimentation, four connection holes 23 have been determined to be sufficient to securely connect the tongue member 20 to a shoe and then control a bowling ball. The second end 27 can be securely fastened to a shoe by inserting shoe laces of the shoe through the shoe connection holes 23 in a similar fashion as the shoe laces are laced into the shoe to provide a secure fit on a user's foot. In other words, the shoe laces can be fed through the shoe connection holes 23 the same way as laces are fed through holes in a shoe. Alternatively, any number of holes 23 can be used, as well as any positioning of the holes 23 which would provide the intended purposes herein of securely connecting the tongue member 20 to a shoe for use of controlling a bowling ball for bowling purposes.

The tongue member 20 can also be made from a metal such as aluminum, or a similar metal or material that can be shaped by the user after purchase in order to customize the bowling apparatus 300 to fit the user's shoe. In another example embodiment, the tongue member 20 can be pre-molded using a plastic material or a synthetic resin, or fiberglass for differently sized balls. Moreover, the bracket member 10 and the tongue member 20 can be pre-molded together during a single manufacturing process to be one integrated piece. It this case the apparatus 300 can be manufactured in different sizes, where the user is not required to bend the bracket member 10 to customize the bracket member 10 for a ball of a particular size.

Referring back to FIG. 3A, the exposed fully assembled bowling apparatus 300 illustrates the bracket member 10 and the tongue member 20 connected together via the screws 13 (see FIG. 1A). As pointed out above, first end portion 25 does not overlap with the sides of the bracket member 10. In other example embodiments, the bracket member 10 and the tongue member 20 can be alternatively connected together in other ways that will securely fasten the two portions together, such as, for example welding, molding, a combination of nuts and bolts, etc.

Figure 3B:
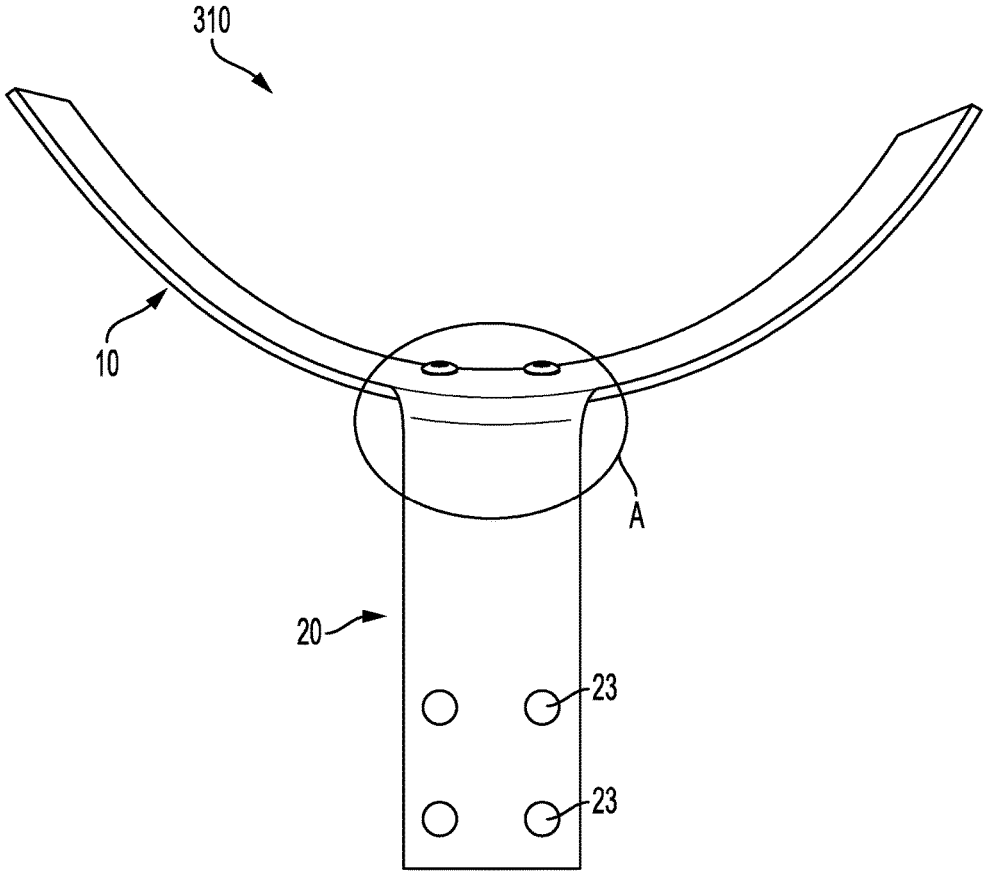
FIG. 3B illustrates another example embodiment of an exposed foot based bowling apparatus in accordance with the present inventive concept.

FIG. 3B illustrates another example embodiment of a bowling apparatus 310 where the bracket member 10 and tongue member 20 are formed together as one piece by cutting a sheet of metal (i.e., aluminum) into the shape of the letter "T", and then bending the top part of the "T" over to approximately 90 degrees as illustrated by "A" from the bottom part. The bent over part is then curved to form the bracket member 10 and the bottom part has holes 23 formed therein to be laced with the laces of a shoe, similar to the tongue 20 described above with reference to FIG. 3A. The shapes and dimensions of each of the bracket member 10 and tongue member 20 of the bowling apparatus 310 are the same as the shapes and dimensions of the bowling apparatus 300 if FIG. 3A.

FIG. 4 illustrates the bowling apparatus 300 of FIG. 3A or the bowling apparatus 310 of FIG. 3B in its fully finished form, which is referred to as bowling apparatus 400. More specifically, in order to provide a soft feel and cushioning of a ball, the apparatus of FIG. 3A or FIG. 3B is covered with a material over its entire surface. The bracket member 10 can include a first fabric that is of a sufficient length to wrap around its entire surface until the bracket member 10 is fully covered. Each end of the fabric can be sewn together to enclose the ends of the bracket 10. Still referring to FIG. 4, the tongue member 20 can include a second fabric of the same material as the first fabric and of sufficient length to wrap around the entire its entire surface until the tongue member 20 is fully covered. Each end of the fabric can be sewn together to enclose the ends of the tongue member 20.

Figure 5:
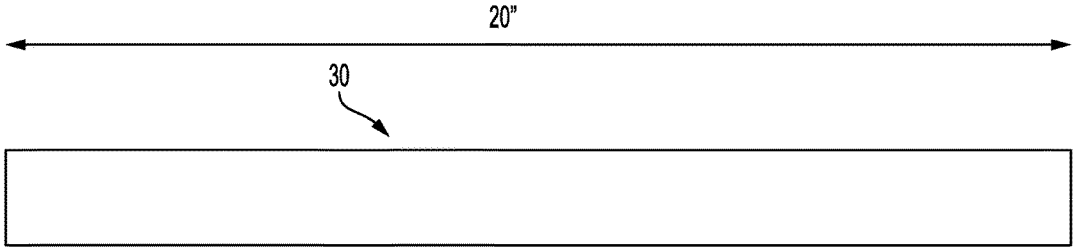
FIG. 5 illustrates a cover for the exposed bracket portion of the foot based bowling apparatus according to FIG. 1A.

FIG. 5 illustrates a fabric 30 that can be used to cover the bracket member 10. Fabric 30 can be approximately 20 inches in length to be sufficient in length to wrap around the entire bracket portion 10 having a width of approximately 1.25 inches and a length of approximately 9 inches, as illustrated in FIG. 1B.

Figure 6:
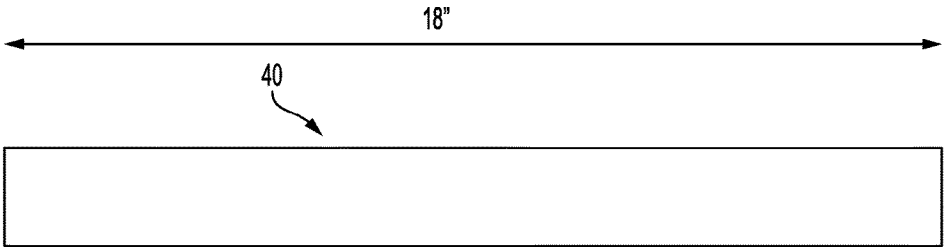
FIG. 6 illustrates a cover for the exposed tongue portion of the foot based bowling apparatus according to FIG. 2A.

FIG. 6 illustrates a fabric 40 that can be used to cover the tongue member 20. Fabric 40 can be approximately 18 inches in length to be sufficient in length to wrap around the entire tongue member 20 having a width of approximately 1.25 inches and a length of approximately 5.5 inches, as illustrated in FIG. 2B. Moreover, the fabric 40 has sufficient extra length after wrapping around the entire tongue member 20 to be then folded over a middle part of the center portion 29 of the bracket member 10 where the bracket member 10 and the tongue member 20 are connected and then the fabric 40 is adhered to itself. A remaining portion of the fabric 40 between the laces and the bracket member 10 may be separately attached to the top of the shoe, for example by an adhesive or Velcro®, as illustrated in FIG. 10. It is to be noted that in an example embodiment where a shoe and the bowling apparatus are manufactured together as one product, the fabric 40 can be permanently attached to the top of the shoe, as is explained in more detail while referring to FIG. 7B and FIG. 9. For example, FIG. 7B illustrates where the fabric 40 integrates into the shoe after covering the tongue member 20 (not illustrated). The integration of the fabric 40 into the shoe can performed by sewing the fabric 40 into the material of the shoe, by using an adhesive, or any known method of connecting fabrics to each other.

The fabric for both the bracket member 10 and tongue member 20 can be made of any material that will withstand sliding across the floor and other impacts that occur while pushing a bowling ball across a floor, such as, for example nylon, polyester, canvas or other similar materials.

In operation, finished bowling apparatus 400 is moved to contact a stationary bowling ball, for example with a kicking motion. The arms 15 and 17 of the bracket member 10 are positioned to hold the ball securely and allow the user to accelerate and aim the ball, for example by continuing the same kicking motion that contacted the ball. A user can therefore accurately aim a bowling ball by adjusting the angle of their shoe to the ball. Once the ball is accelerated and aimed, it moves away from the bowling apparatus 400 and the shoe to which the bowling apparatus 400 is connected. The ball may then move down a bowling lane towards the pins at the far end of the lane.

Figure 7A:
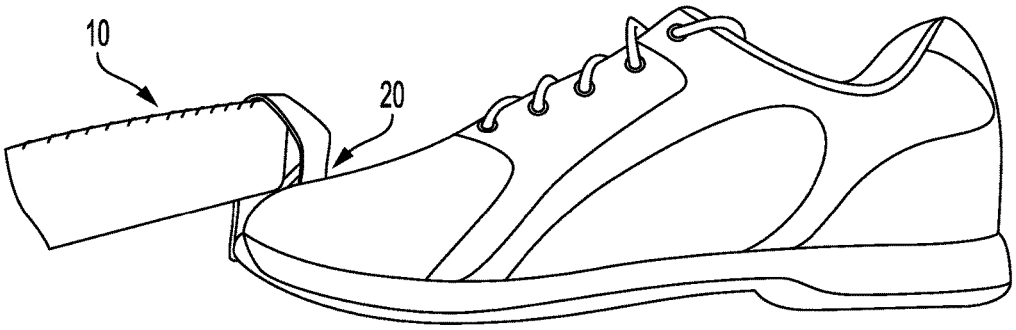
FIG. 7A illustrates the fully assembled foot based bowling apparatus of FIG. 4 with the tongue portion adapted to be formed into a shoe.
Figure 7B:
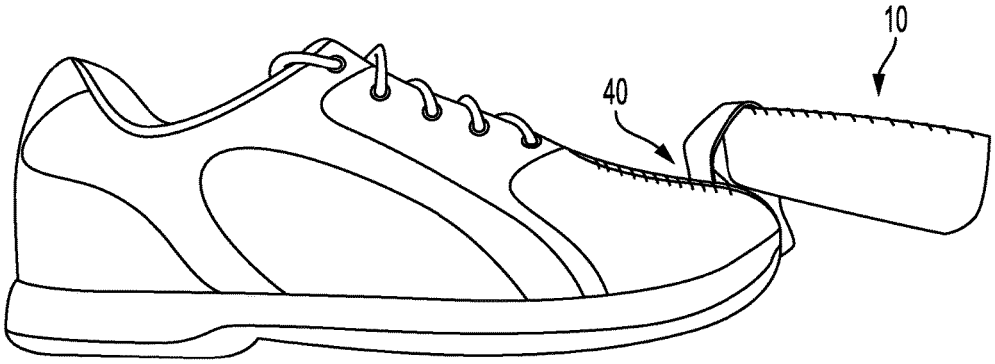
FIG. 7B illustrates the fully assembled foot based bowling apparatus of FIG. 4 with the tongue portion laced onto a shoe.

FIG. 7A illustrates a side view of the tongue member 20 of the bowling apparatus 400 as being formed within a shoe according to an example embodiment of the present inventive concept. In this example embodiment, the shoe and bowling apparatus 400 can be manufactured together as one apparatus.

FIG. 7B illustrates a side view of the tongue member 20 (covered by the fabric 40) of the bowling apparatus 400 as being formed outside a shoe according to an example embodiment of the present inventive concept. In this example embodiment, the fabric 40, and hence the tongue member 20 can be adhered at a top of the shoe below the laces by an adhesive or Velcro®.

Figure 7C:
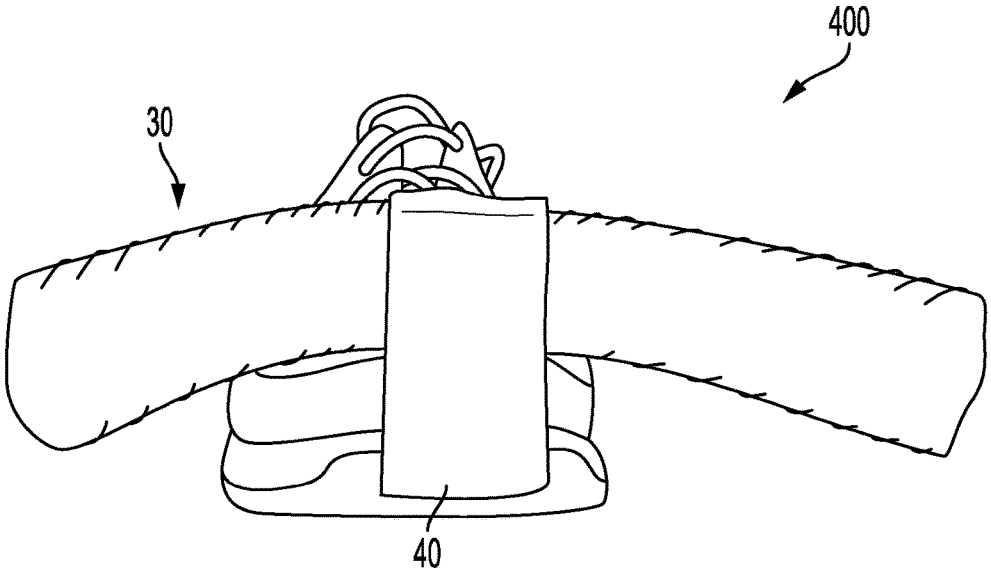
FIG. 7C illustrates a front view of the foot based bowling apparatus of FIGS. 7A and 7B.

FIG. 7C illustrates a front view of the bowling apparatus 400. This view shows a front view of the fabric 30 (and hence the bracket member 10) which will come into contact with and control the bowling ball.

Figure 7D:
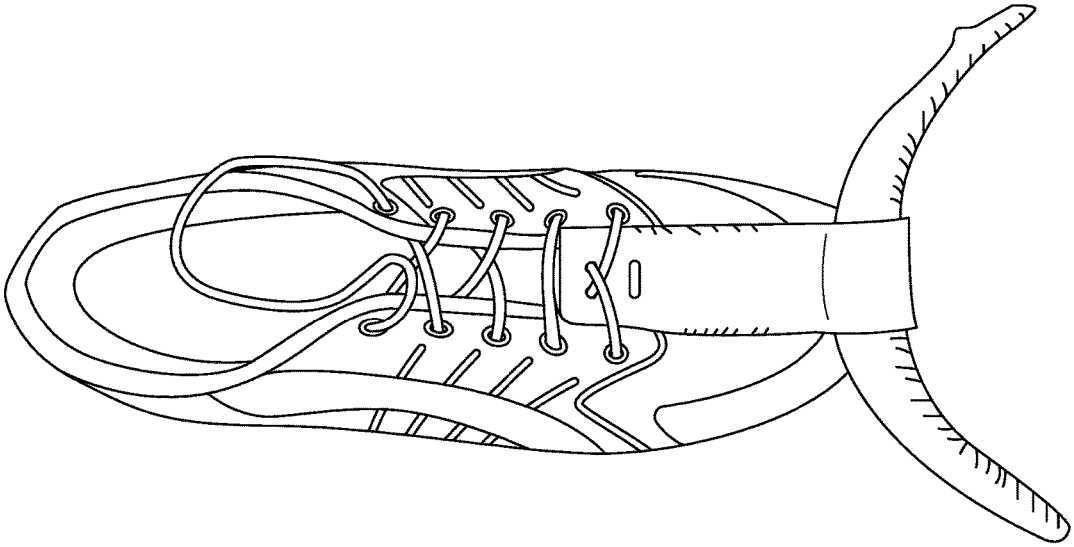
FIG. 7D illustrates a top view of the foot based bowling apparatus of FIG. 7B.

FIG. 7D illustrates a top view of the bowling apparatus 400 as it is attached to a shoe by lacing the tongue member 10 to the shoe with laces.

Figure 8:
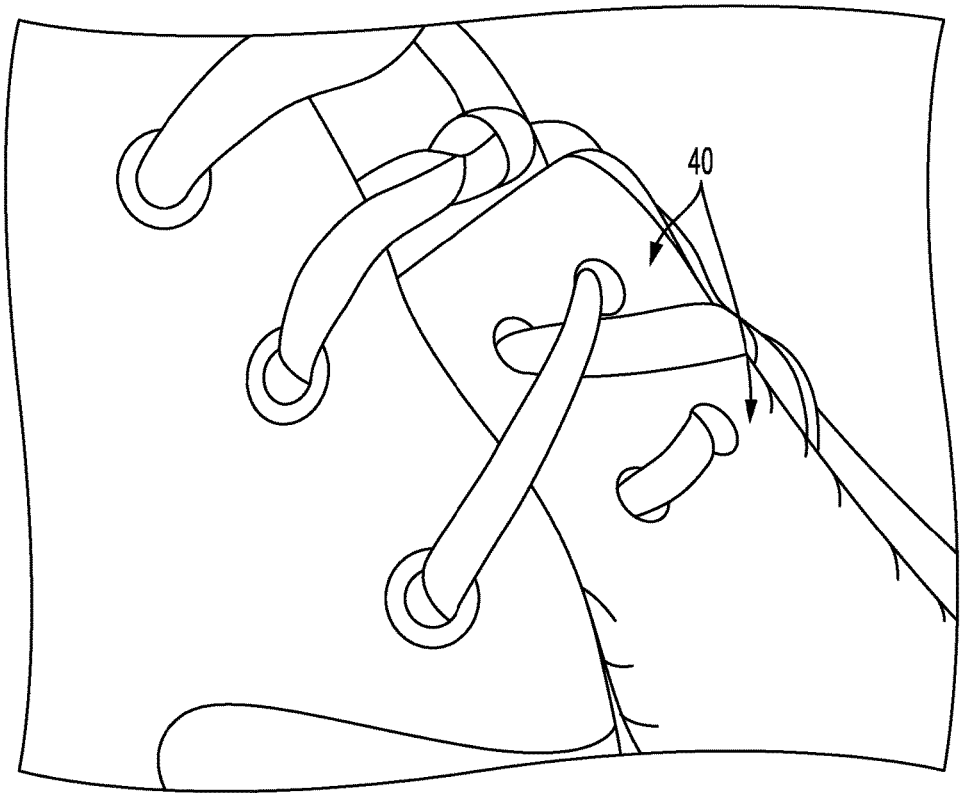
FIG. 8 illustrates a close-up view of the tongue of the foot based bowling apparatus of FIG. 7B being laced to a shoe.

FIG. 8 illustrates a close up view of the bowling apparatus 400 of FIG. 7D where the four lace holes 23 of the tongue member 20 are laced to the shoe.

Figure 9:
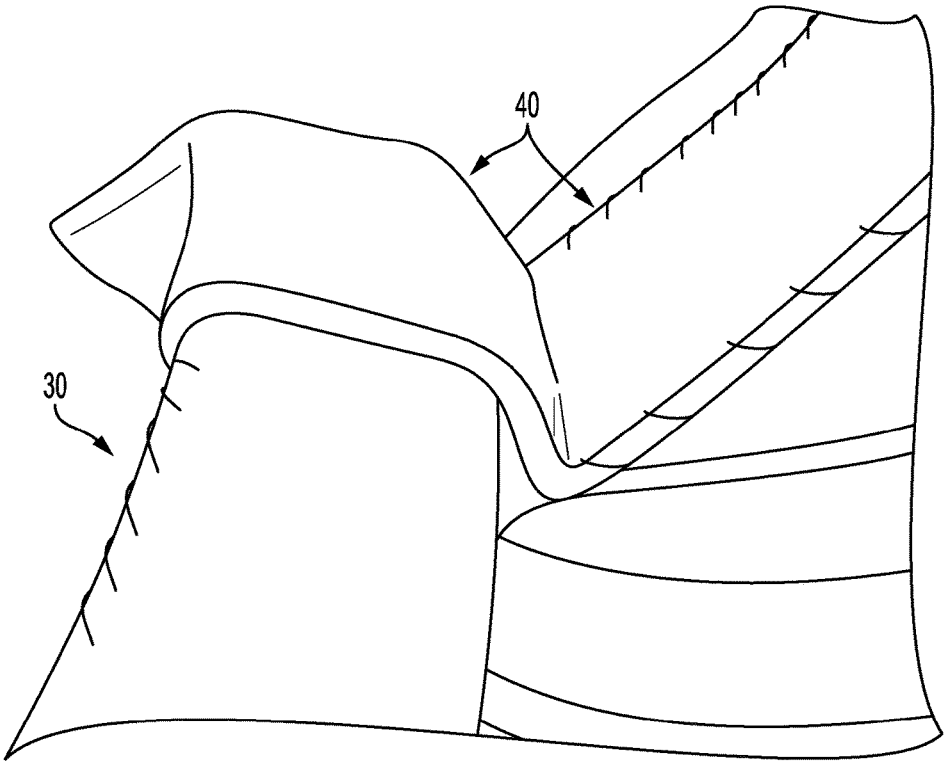
FIG. 9 illustrates a close-up view of the foot based bowling apparatus of FIG. 4 with the tongue portion adhered onto a top portion of a shoe.
Figure 10:
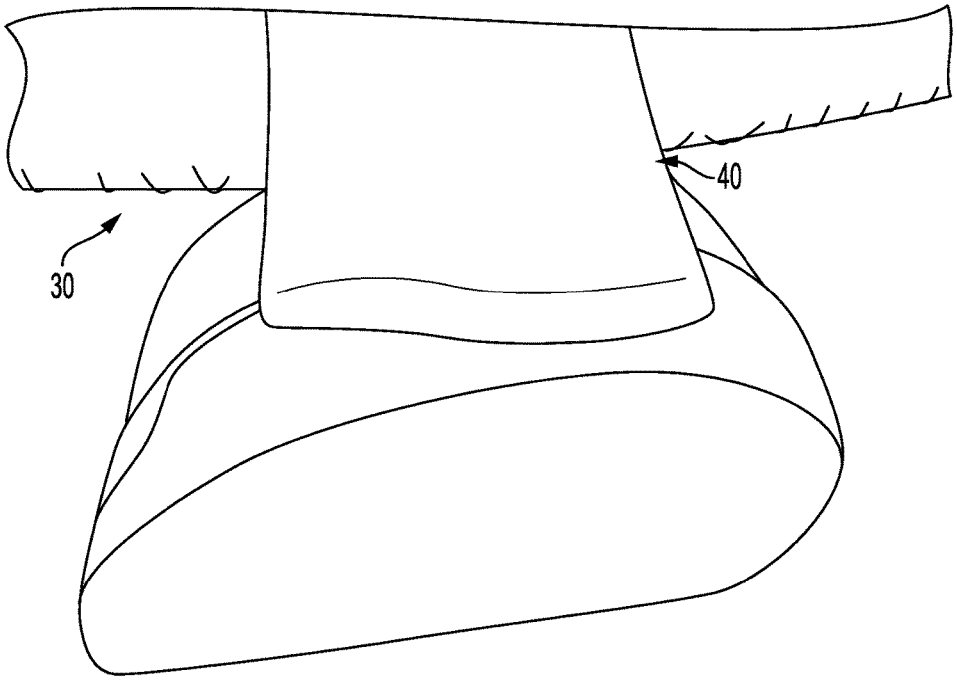
FIG. 10 illustrates a close-up view of the foot based bowling apparatus of FIG. 4 with the tongue portion adhered onto tip of a shoe.

FIG. 9 illustrates a close up view of the bowling apparatus 400 of FIG. 7B where the tongue member 20 is adhered to the top of the shoe below the laces. Both the fabric 30 wrapped around the bracket member 10 and the fabric 40 wrapped around the tongue portion 20 are illustrated.

Figure 11:
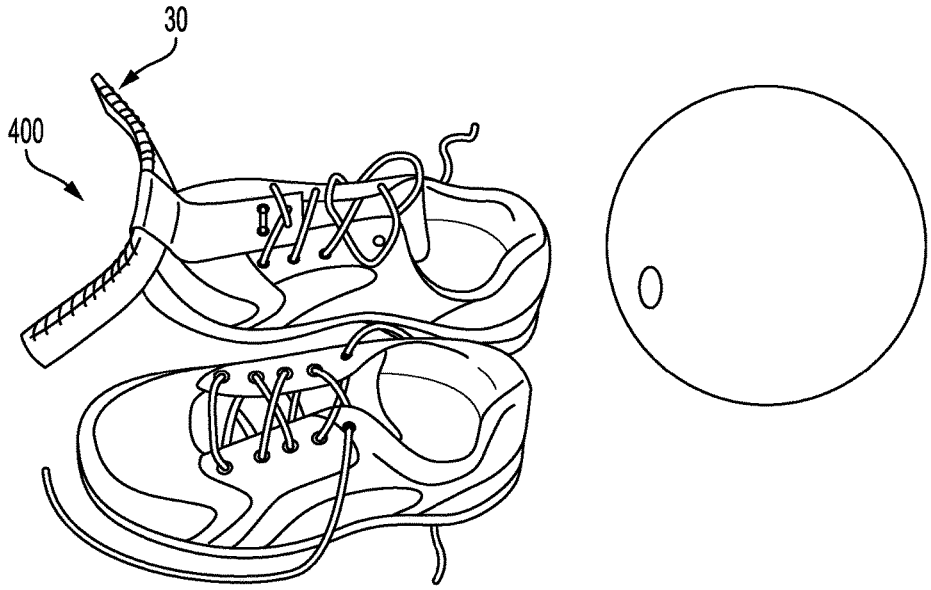
FIG. 11 illustrates top view of the foot based bowling apparatus in accordance with example embodiments in a finished form attached to a shoe.

FIG. 11 illustrates a top view of the bowling apparatus 400 as it is laced to a shoe and ready to use for bowling.

As pointed out above, the bowling apparatus 400 can be formed to a different size and shape in order to accommodate balls of different sizes used in different games, such as bocce ball, croquet, etc.

Accordingly, it is to be understood that the embodiments of the inventive concept herein described are merely illustrative of the application of the principles of the inventive concept. Reference herein to details of the illustrated embodiments is not intended to limit the scope of the claims, which themselves recite those features regarded as essential to the inventive concept.

What is claimed is:

1. A bowling apparatus, comprising:

a bracket member having a concave shape to fit a ball of a predetermined size therein; and a tongue member including:

a first end bent upward at an angle of substantially 90 degrees from a center portion thereof, the first end being of a length substantially equal to a width of the bracket member and attached along a width of a center of the bracket member; and a second end bent upward from the center portion thereof at an angle sufficient to rest entirely over a tongue of a shoe while maintaining the first end extending away from a surface on which the shoe rests, the second end including lace holes configured to receive shoe laces tied above the tongue of the shoe in which the second end rests such that when the second end is laced over the tongue of the shoe the bracket securely rests above a front end of the shoe to receive the ball therein.

2. The bowling apparatus of claim 1, wherein the bracket member and tongue member are enclosed in a fabric.

3. The bowling apparatus of claim 2, wherein the first end of the tongue member and the center of the bracket member are attached by screws.

4. The bowling apparatus of claim 2, wherein the first end of the tongue member and the center of the bracket member are attached by welding.

5. The bowling apparatus of claim 2, wherein the first end of the tongue member and the center of the bracket member are formed of one piece by a molding process.

6. The bowling apparatus of claim 2, wherein the first end of the tongue member and the center of the bracket member are formed from one piece of metal.

7. The bowling apparatus of claim 2, wherein the second end of the tongue member includes four lace holes formed to align with four lace holes of a shoe.

8. The bowling apparatus of claim 2, wherein:

the first end of the tongue member is substantially 1.5 inches in length, the center of the tongue member is substantially 3 inches in length, the second end of the tongue member is substantially one inch in length, and the width of the tongue member is substantially 5.5 inches in length; and the bracket member is substantially 9 inches in length and substantially 1.24 inches in width such that outer ends thereof are substantially 7.25 inches apart.

9. A ball rolling apparatus, comprising:

a bracket member having a concave shape to receive therein and remain in contact with at least one third of a circumference of a ball of a predetermined size; and a tongue member including:

a first end bent upward at an angle of substantially 90 degrees from a center portion thereof, the first end being of a length substantially equal to a width of the bracket member and attached along a width of a center of the bracket member; and a second end bent upward from the center portion thereof at an angle sufficient to rest entirely along a length of a tongue of a shoe while maintaining the first end perpendicular to a surface on which the shoe rests, the second end including lace holes configured to receive shoe laces tied above the tongue of the shoe in which the second end rests such that when the second end is laced over the tongue of the shoe the bracket securely rests above a front end of the shoe to receive the ball therein.

10. The apparatus of claim 9, wherein the ball is a bocce ball.

11. The apparatus of claim 9, wherein the ball is a croquet ball.

12. The apparatus of claim 9, wherein the bracket member and tongue member are welded together.

13. The apparatus of claim 9, wherein the bracket member and tongue member are molded together as a single piece.

14. The apparatus of claim 9, wherein the bracket member and tongue member are made from aluminum.

15. The apparatus of claim 9, wherein the bracket member and tongue member are formed from of a resin.

16. The apparatus of claim 9, wherein the bracket member and tongue member are formed from one piece of metal.

17. A ball rolling apparatus, comprising:

a bracket member having a concave shape to receive therein and remain in contact with at least one third of a circumference of a ball of a predetermined size while pushing the ball; and a shoe including a tongue member integrally formed with and extending from a front of the shoe, the tongue member including:

a first end bent upward at an angle of substantially 90 degrees from a center portion thereof, the first end being of a length substantially equal to a width of the bracket member and attached along a width of a center of the bracket member; and a second end bent slightly upward while extending away from the front of the shoe while substantially maintaining the center portion substantially perpendicular to a surface on which the shoe rests.

18. The apparatus of claim 17, wherein the ball is a croquet ball.

19. The apparatus of claim 17, wherein the ball is a bowling ball.

20. The apparatus of claim 17, wherein the ball is a bocce ball.

21. The bowling apparatus of claim 17, wherein the bracket member and the tongue member are enclosed in a fabric.

22. The bowling apparatus of claim 21, wherein the first end of the tongue member and the center of the bracket member are attached by screw.

23. The bowling apparatus of claim 21, wherein the first end of the tongue member and the center of the bracket member are attached by welding.

24. The bowling apparatus of claim 21, wherein the first end of the tongue member and the center of the bracket member are attached by a molding process.

25. The bowling apparatus of claim 17, wherein the tongue member and the bracket member are formed from one piece of metal.

* * * * *